US008272924B2

(12) United States Patent
Van Eijden et al.

(10) Patent No.: US 8,272,924 B2
(45) Date of Patent: Sep. 25, 2012

(54) GRINDING HEAD FOR A SURFACE GRINDING MACHINE

(75) Inventors: Barry Johannes Van Eijden, Houten (NL); Adrianus Gerardes Van Houten, Schalkwijk (NL)

(73) Assignee: Blastrac B.V. (NL)

( * ) Notice: Subject to any disclaimer, the term of this patent is extended or adjusted under 35 U.S.C. 154(b) by 0 days.

(21) Appl. No.: 13/348,482

(22) Filed: Jan. 11, 2012

(65) Prior Publication Data

US 2012/0122378 A1 May 17, 2012

Related U.S. Application Data

(63) Continuation of application No. PCT/NL2009/000150, filed on Jul. 15, 2009.

(51) Int. Cl.
*B24B 1/00* (2006.01)

(52) U.S. Cl. ..... 451/56; 451/353; 451/359; 451/548

(58) Field of Classification Search ..... 451/56, 451/353, 359, 548, 550, 494, 538, 539
See application file for complete search history.

(56) References Cited

U.S. PATENT DOCUMENTS

| | | | | |
|---|---|---|---|---|
| 4,219,898 | A * | 9/1980 | Presby | 15/49.1 |
| 4,222,204 | A * | 9/1980 | Benner | 451/494 |
| 5,170,595 | A * | 12/1992 | Wiand | 451/538 |
| 5,247,765 | A | 9/1993 | Quintana | |
| 5,357,717 | A * | 10/1994 | Friel et al. | 451/494 |
| 5,567,503 | A * | 10/1996 | Sexton et al. | 428/143 |
| 6,234,886 | B1 * | 5/2001 | Rivard et al. | 451/353 |
| 7,033,258 | B2 * | 4/2006 | Jordan | 451/350 |
| 7,997,960 | B2 * | 8/2011 | Williams, Sr. | 451/353 |
| 2006/0073776 | A1 * | 4/2006 | Gallup | 451/353 |
| 2006/0172667 | A1 * | 8/2006 | Jeansson | 451/353 |
| 2008/0176498 | A1 | 7/2008 | Rossi et al. | |

FOREIGN PATENT DOCUMENTS

DE 2904114 8/1980

* cited by examiner

*Primary Examiner* — George Nguyen

(74) *Attorney, Agent, or Firm* — Lando & Anastasi, LLP

(57) ABSTRACT

The invention relates to a grinding head for a grinding machine. The grinding head comprises a tool holder, which in use is moved in a plane, in particular rotated or translated back and forth, by the grinding machine. The grinding head furthermore comprises at least two tools which are connectable to the tool holder by a releasable sticking connection. One of the tools or the tool holder is provided with at least one protrusion and the other one is provided with an associated cavity to lock which extend transverse to said plane of movement of the tool with respect to the tool holder in a direction parallel to said plane when the tool is connected to the tool holder.

11 Claims, 2 Drawing Sheets

GRINDING HEAD FOR A SURFACE GRINDING MACHINE

CROSS REFERENCE TO RELATED APPLICATION

This application is a continuation of and claims priority to International Application Number PCT/NL2009/000150, filed Jul. 15, 2009 under 35 U.S.C. §371 which is entirely incorporated herein by reference for all purposes, and to which this application claims the benefit of priority.

FIELD OF THE INVENTION

The invention relates to a grinding head for a surface grinding machine, comprising a tool holder, which in use is moved in a plane, in particular rotated or reciprocated, by the grinding machine, the tool holder being adapted to connect at least two tools thereto. Furthermore the grinding head comprises at least two grinding tools which are connectable to the tool holder by a releasable sticking connection.

BACKGROUND

With a releasable sticking connection is meant a connection wherein two parts can be connected and disconnected by hand and, when connected, "stick" to each other. Examples of a releasable sticking connection are a magnetic connection, electrostatic connection, a hook and loop fastener connection, a connection using a re-adherable adhesive, such as in the post-it notes, etc. The advantage of such a connection is that grinding tools can be replaced easily compared to a clamping connection using bolts and nuts which requires the use of equipment to be loosened or tightened.

A grinding head of the type mentioned in the preamble is known from US2006/073776 A1, in which a releasable sticking connection comprising a hook and loop fastener (often referred to as Velcro®) is disclosed to connect a tool to a tool holder.

The known grinding heads are used in industrial surface grinding machines to grind or polish relatively large areas made of hard materials, e.g. concrete or marble floors. During these processes, grinding tools may be dislocated or even separated from the tool holder due to the large frictional shear forces between the tools and the material to be grinded or polished, thereby resulting in an uncontrolled or even disrupted grinding and/or polishing process.

SUMMARY

It is an object of the invention to provide an improved grinding head.

The invention therefore provides a grinding head for a surface grinding machine, comprising:

- a tool holder, which in use is moved in a plane, in particular rotated or reciprocated, by the grinding machine, the tool holder being adapted to connect at least two tools thereto;
- at least two grinding tools which are connectable to the tool holder by a releasable sticking connection, wherein one of the grinding tools and the tool holder is provided with at least one protrusion and the other one is provided with a complementary cavity which extend transverse to said plane of movement to prevent slippage of the grinding tools with respect to the tool holder in a direction parallel to said plane when the tool is connected to the tool holder.

An advantage of the grinding head according to the invention is that the protrusion and associated cavity cooperate with each other thereby providing the necessary resistance against shear forces applied to the grinding tools during the grinding or polishing process. This reduces the stresses on the releasable sticking connection and efficiently locks the position of the grinding tool in the plane of movement thereby preventing the tool from being slipping with respect to the tool holder. Preferably, two or more protrusions and associated cavities are provided, so that the tool is not able to translate nor to rotate with respect to the tool holder.

When mounting a grinding tool to the tool holder, the protrusion, which may be provided on the tool holder or on the grinding tool, slides into the cavity which is provided on the grinding tool or the tool holder. The grinding tool is connected to the tool holder by the releasably sticking connection, preferably by application of magnetic attraction or hook and loop fasteners. Thus a which is easily installed on and de-installed from the tool holder without the use of tools like screwdrivers, spanners etc. This is in particular advantageous when disposable grinding tools are replaced by new ones during grinding or polishing a (floor) surface, because a lot of time is saved, while still a secure connection between the grinding tools and the tool holder is obtained.

In an embodiment, the releasable sticking connection comprises magnets, preferably neodymium magnets, to connect the at least two grinding tools to the tool holder. During the grinding or polishing process, the friction between the grinding tool and the material to be grinded or polished generates a lot of heat thereby increasing the temperature of at least the tool, possibly also the tool holder. The magnets have the advantage that they can withstand the the increased temperatures without losing their function of holding the tool. Another advantage is that the magnets provide a predictable force between the tool and tool holder independent of a pressure exerted to the tool when connecting the tool to the tool holder, dust, or other disturbances that may occur during normal operation.

Preferably, the magnets, which preferably are permanent magnets, are attached to the tool holder and the tool comprises magnetic or magnetisable material. An advantage of providing the magnets on the tool holder is that less magnets are required as the tools are the components which are regularly replaced by other tools. Thus only one set of magnets per tool holder is required instead of one or more magnets per tool. Another advantage may be that a risk of interference of magnets with other systems or the attraction of for instance metal particles or parts is less then in a situation wherein the magnets are provided on the tools, because the tools are more likely to be displaced then the tool holder which is most of the time mounted to a grinding machine.

In order to lock the position of the magnets with respect to the tool or tool holder if applicable, the magnets are preferably attached to the tool or tool holder by an adhesive, i.e. glued. This is especially advantageous in case of disconnecting the tool from the tool holder wherein the magnets for instance may "stick" to the tool where it may be preferred that the magnets "stick" to the tool holder.

In a possible embodiment, the tool holder has a surface facing the at least two tools, wherein the magnets have a tool facing surface which lies flush with said tool facing surface of the tool holder. This also aids in locking the position of the magnets especially in case of disconnecting the tool from the tool holder. Another advantage is that the tool does not require provisions, such as cavities, to match with the magnets, thereby allowing a simpler fabrication process of the tool and simplifying the connection and disconnection of the tool.

Alternatively, the magnets may have a tool facing surface which lies recessed with respect to the tool facing surface of the tool holder, so that there exists a small gap between the magnet and the tool when connected. It is possible that in use the tools are subjected to severe shocks that might damage the magnets when the magnets are in direct contact with the tools. By providing a small gap between the magnets and the tools it is prevented that shocks applied to the tools damage the magnets.

In another embodiment, the releasable sticking connection comprises a hook and loop fastener, often referred to as Velcro®,to connect the at least two tools to the tool holder. A hook and loop fastener has the advantage to be a relatively cheap solution and also does not attract metal parts nor is it able to interfere with other systems as it does not produce a magnetic or electric field.

In case the releasable sticking connection comprises a hook and loop fastener, a piece of fabric covered with tiny hooks is provided on the tool holder and a piece of fabric covered with small loops is provided on the tool or vice versa, so that the hooks are able to catch in the loops to provide a releasable sticking connection. It is also possible that both pieces of fabric are covered with hooks.

Preferably, the hook and loop fastener on the tool covers substantially an entire surface of the tool facing the tool holder when connected to increase the contact surface of the releasable sticking connection. The hook and loop fastener on the tool holder is preferably made out of one piece to simplify fabrication and assembly of the hook and loop fastener to the tool holder. The hook and loop fastener is preferably attached to the grinding tool and tool holder using an adhesive, i.e. glued.

In another embodiment, the tool comprises a carrier and an abrasive element held on the carrier, wherein the at least one protrusion or cavity if applicable is provided on or in the carrier.

Preferably, three protrusions and associated cavities are provided for each grinding tool.

Preferably, the tool holder is rotatable around a rotation axis and the grinding tools are mounted eccentric on the tool holder.

In an embodiment, the tool holder is provided with a cutaway at an edge thereof such that an edge of a connected grinding tool extends beyond said edge of the tool holder so as to allow to push against a surface of the connected grinding tool facing the tool holder. This allows an easy and quick disconnection of the grinding tool from the tool holder.

For the invention, components of the releasable sticking connection may be provided on both the grinding tool and the tool holder or vice versa. It is therefore apparent to a person skilled in the art that abovementioned features relating to the releasable sticking connection and the tool holder may also apply for the grinding tool, and features relating to the releasable sticking sticking connection and the grinding tool may also apply for the tool holder.

The invention also relates to a grinding machine comprising at least one grinding head as described above.

In a preferred embodiment the grinding machine is a planetary grinding machine which comprises a plurality of grinding heads.

The invention also relates to a method to replace a first tool with a second grinding tool on a tool holder, the tools or tool holder comprising at least two protrusions and the other comprising corresponding cavities, said method comprising the following steps:

disconnecting the first grinding tool from the tool holder by hand by releasing a releasable sticking connection;

aligning the protrusions and associated cavities for the second grinding tool;

connecting the second tool to the tool holder by sliding the protrusions into the corresponding cavities and using the releasable sticking connection.

BRIEF DESCRIPTION OF THE DRAWINGS

The invention will now be described in a non-limiting way by reference to the drawing, wherein like reference numerals refer to like parts. In the drawing.

DETAILED DESCRIPTION OF THE DRAWINGS

Figure 1:
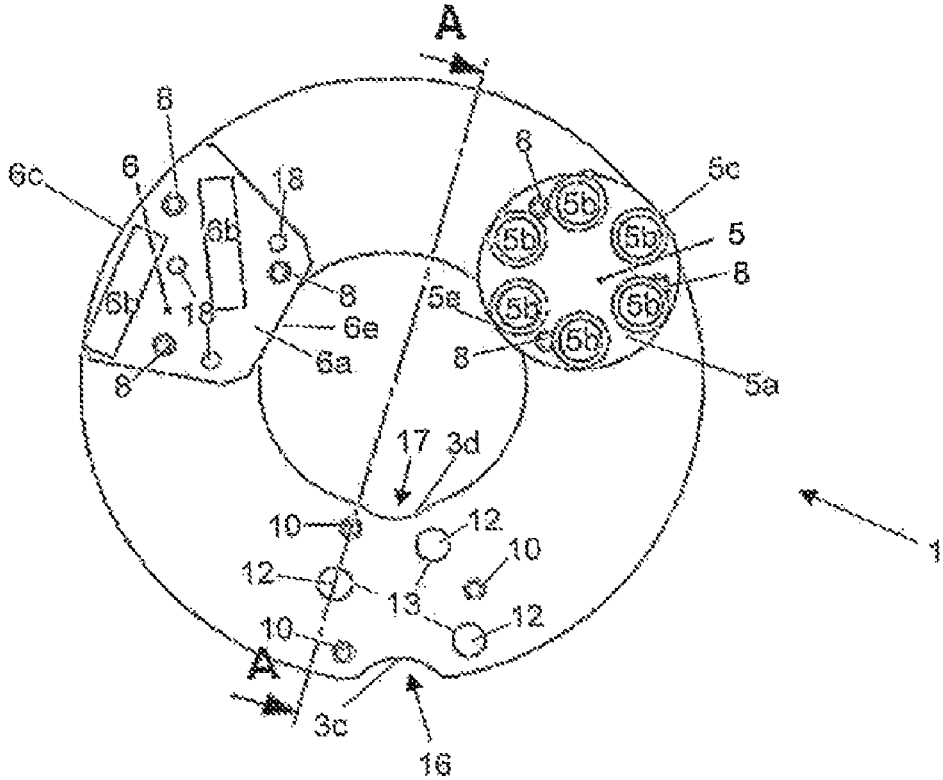
FIG. 1 shows a grinding head according to an embodiment of the invention.

FIG. 1 shows a grinding head 1 according to an embodiment of the invention. The grinding head 1 is used for a grinding machine, preferably an industrial grinding machine, to grind or polish large surface areas of hard material, e.g. concrete or marble. The grinding head 1 comprises a tool holder 3 and at least two grinding tools 5, 6 which are connectable to the tool holder by a releasable sticking connection. In FIG. 1, the tools 5, 6 are shown in the connected position.

In the example shown the tool holder 3 is configured as a disc shaped plate with a central hole. The tool holder has a tool facing surface 14 on which the tools 5, 6 are placed.

The disc shaped plate can be one of a plurality of plates which are mounted eccentric in a planetary surface grinding machine.

In total three grinding tools 5, 6 can be connected to the tool holder 3 at the same time. As an example, grinding tool 5 is adapted for polishing a surface and grinding tool 6 is adapted for grinding a surface. For the purpose of illustration, FIG. 1 shows both grinding tool types 5, 6 connected to the tool holder at the same time. In practice, it will be more common to have only one tool type connected to the tool holder 3 at a time. Thus in the example shown, three polishing grinding tools 5 will be connected to the tool holder to polish a surface and three grinding tools 6 will be connected to the tool holder 3 to grind a surface. At the bottom of the tool holder 3 of FIG. 1, an empty spot is shown where also another tool 5, 6 can be positioned. This empty spot is used to show the construction of the tool holder 3 when a grinding tool is not connected to the tool holder 3.

The grinding tools 5, 6 are provided with three cavities in the form of holes 8, and the tool holder 3 is provided with three complementary protrusions in the form of dowel pins 10 (also shown in detail in FIG. 2) to lock the position of the tool 5, 6 with respect to the tool holder 3 when the tool is connected to the tool holder 3. The dowel pins 10 are positioned off centre with respect to the centre of the disc shaped tool holder 3. The disc in use rotates around an axis perpendicular to the disc and extending through its centre.

Figure 2:
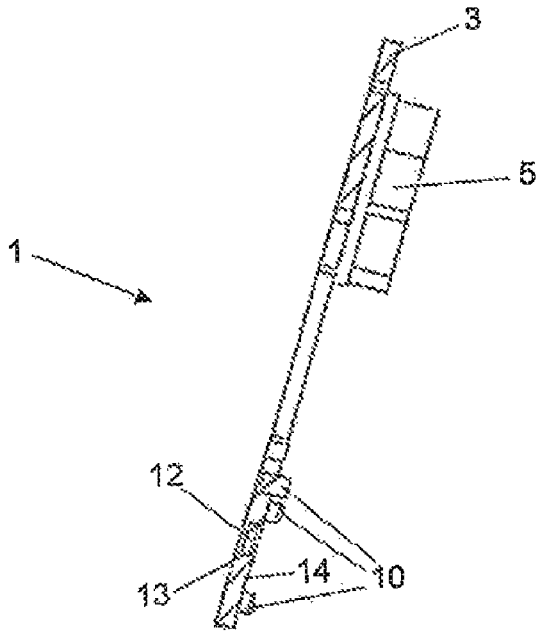
FIG. 2 shows a cross section of the grinding head according to the embodiment of FIG. 1.

The releasable sticking connection comprises three magnets 12, of which one is shown in FIG. 2, per tool 5, 6. The magnets 12 are preferably made from neodymium and attached to the tool holder 3, for instance by gluing, inside a recess 13 of the tool holder 3, so that a tool facing surface of the magnets 12 lies flush with or recessed with respect to the surface 14 of the tool holder 3 facing the grinding tools 5, 6. The grinding tools 5, 6 comprise a carrier 5*a*, 6*a* and an abrasive element 5*b*, 6*b* held on the respective carrier 5*a*, 6*a*. In the example shown the carriers 5*a* and 6*a* are plate like elements. The carrier 5*a*, 6*a* is made of magnetic or magnetizable material to cooperate with the magnets 12. The magnets 12 prevent a motion in a direction perpendicular to the surface 14 of the tool holder 3 and the dowel pins 10, which are received in the respective holes 8, prevent a motion in a direction parallel to the surface 14 of the tool holder 3. The position of the grinding tools 5, 6 on the tool holder 3 is thus locked in all six degrees of freedom when the grinding tools 5, 6 are connected to the tool holder 3.

Figure 3:
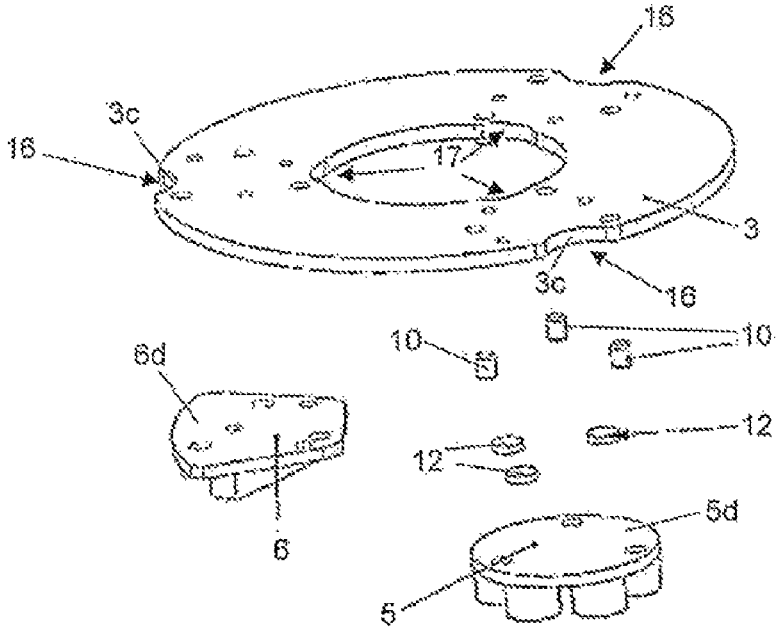
FIG. 3 shows an exploded view of the grinding head according to the embodiment of FIG. 1.

The tool holder 3 further comprises at the outer edge thereof, a cut-away 16 for each grinding tool 5, 6 such that an edge 5*c*, 6*c* of a connected grinding tool 5, 6 extends beyond said edge 3*c* of the tool holder 3 so as to allow to push against a surface 5*d*, 6*d* (shown in detail in FIG. 3) of detail in FIG. 3) of the connected grinding tool 5, 6 facing the tool holder 3. In this embodiment, also a cut-away 17 is provided on the edge 3*d* of the central hole in the tool holder 3 such that an edge 5*e*, 6*e* of a connected grinding tool 5, 6 extends beyond the edge 3*d* of the tool holder 3 so as to allow to push against the surface 5*d*, 6*d* of the connected grinding tool 5, 6 facing the tool holder 3. This allows a user to push the grinding tools 5, 6 from the tool holder 3, when they should be disconnected from the tool holder 3.

FIG. 2 shows a cross section of the grinding head 1 according to the embodiment of FIG. 1 along line A-A. In this FIG. 2 the dowel pins 10 can be clearly seen in the empty spot at the bottom of the tool holder 3. Furthermore it can be seen that the tool holder 3 is provided with recesses 13 in each of which a magnet 12 is located, such that the tool facing surface of the magnet lies recessed slightly with regard to the tool facing surface 14 of the tool holder.

FIG. 3 shows an exploded view of the grinding head 1 according to the embodiment of FIG. 1. FIG. 3 clearly shows the cut-aways 16, 17 for each grinding tool 5, 6 located along the perimeters 3*c*, 3*d* of tool holder 3, so as to allow to push against the surface 5*d*, 6*d* of the connected grinding tool 5, 6 facing the tool holder 3. This simplifies the disconnection of the grinding tool 5, 6 from the tool holder 3.

Replacing grinding tool 5 with for instance grinding tool 6 on the tool holder can be done by following the following steps:

first the tool 5 is disconnected from the tool holder 3 by hand by releasing the releasable sticking connection. This is in this case done by pushing against surface 5*d* of the tool 5, which is accessible due to cut-aways 16, 17. The tool 5 will then be moved in a direction perpendicular to the surface 14 of the tool holder, wherein the magnets 12 stay on the tool holder 3;

second, the tool 6 is taken and the holes 8 of the tool 6 are aligned with the dowel pins 10 of the tool holder 3;

third, the tool 6 is connected to the tool holder 3 by hand using the releasable sticking connection. This is simply done by moving the tool 6 perpendicular to the surface 14 of the tool holder 3 until the magnets 12 are able to hold the tool 6, which is at least the case when surface 6*d* of the tool 6 engages with surface 14 of the tool holder. In this step the dowel pins 10 are received in the holes 8 of the tool and thereby lock the position of the tool with respect to the tool holder.

In this embodiment, tool 6 is provided with holes 18 as well, which allow the tool 6 to be used in prior art grinding heads as well, which require a connection using bolts or screws.

Figure 4:
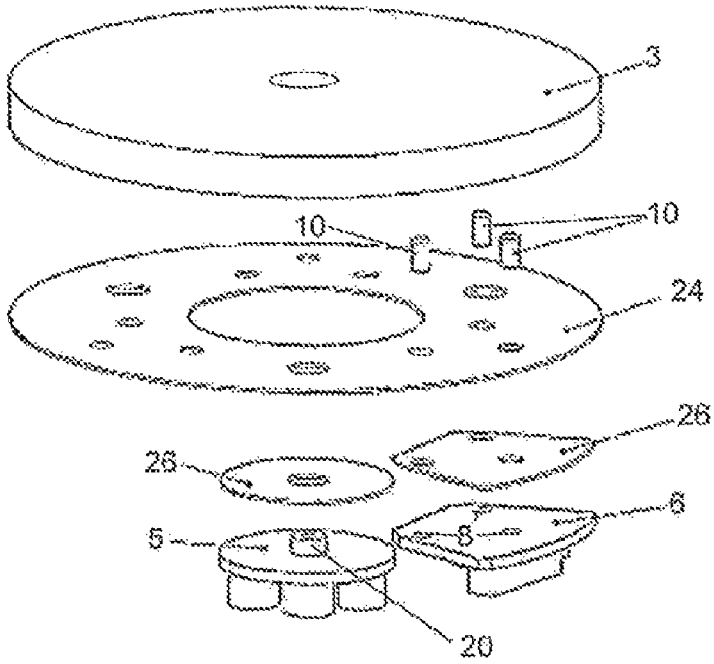
FIG. 4 shows an exploded view of a grinding according to another embodiment of the invention.

FIG. 4 shows an exploded view of a grinding head 1 according to another embodiment of the invention. The grinding head 1 comprises a tool holder 3 and at least two tools 5, 6 which are connectable to the tool holder by a releasable sticking connection.

Tool 5 comprises in this embodiment a single protrusion 20 which can be received in a cavity (not shown) in the tool holder 3 that may have the form of a hole to lock the position of the tool 5 with respect to the tool holder when the tool 5 is connected to the tool holder.

Tool 6 comprises three cavities in the form of holes 8 and the tool holder 3 comprises three protrusions in the form of dowel pins 10 similar to the embodiment of FIGS. 1-3 to lock the position of the tool 6 with respect to the tool holder 3 when the tool 5 is connected to the tool holder 3.

The releasable sticking connection of this embodiment comprises a hook and loop fastener (Velcro®). A Velcro® layer 24 is attached, preferably glued, to the tool holder 3. The Velcro® layer 24 is made out of one piece and comprises holes at locations where the dowel pins 10 or the protrusion 20 have to extend through the Velcro® layer 24 to engage respectively the tool 6 or the tool holder 3.

The tools 5, 6 comprise a corresponding Velcro® layer 26, which is preferably glued to the tool 5, 6, and cooperates with the Velcro® layer 24 to connect the tool 5, 6 to the tool holder 3 as is commonly known to the skilled person.

What is claimed is:

1. A grinding head for a floor surface grinding machine, comprising:

a tool holder configured as a disc shaped plate, which in use is moved by the grinding machine in a plane, the tool holder being adapted to connect at least two grinding tools thereto; and at least two grinding tools which are connectable to the tool;

wherein the tool holder comprises permanent magnets and the at least two grinding tools comprise magnetic or magnetizable material to cooperate with the permanent magnets on the tool holder in order to connect the at least two grinding tools to the tool holder, wherein the tool holder is provided with at least two pins for each grinding tool and the grinding tools are provided with complementary cavities which extend transverse to said plane of movement of the tool holder to prevent movement of the grinding tools with respect to the tool holder in a direction parallel to said plane when the grinding tools are connected to the tool holder, wherein the tool holder has a surface facing the at least two grinding tools when connected thereto, wherein the tool holder comprises a recess for each magnet, and wherein the magnets are provided inside corresponding recesses such that a tool facing surface of the magnets lies recessed with respect to said tool facing surface of the tool holder.

2. The grinding head according to claim 1, wherein the tool holder is rotatable about a rotation axis and the grinding tools are arranged eccentric on the tool holder when the grinding tools are connected to the tool holder.

3. The grinding head according to claim 1, wherein the magnets are glued to the tool holder.

4. The grinding head according to claim 1, wherein the magnets are made of neodymium.

5. The grinding head according to claim 1, wherein the grinding tool comprises a carrier and an abrasive material held on the carrier, and wherein the at least two pins or complimentary cavities if applicable are provided on the carrier.

6. The grinding head according to claim 1, wherein three pins and complementary cavities are provided for each grinding tool.

7. The grinding head according to claim 1, wherein the tool holder, at an edge thereof, is provided with a cut-away such that an edge of a connected grinding tool extends beyond the edge of the tool holder at the location of the cut-away so as to allow to push against a tool holder facing side of the connected tool.

8. The grinding head according to claim 1, wherein the grinding tools are disposable.

9. A floor surface grinding machine comprising at least one grinding head according to claim 1.

10. The floor surface grinding machine according to claim 9, wherein the machine comprises a plurality of the grinding heads mounted in a planetary configuration.

11. A method of facilitating floor grinding comprising:

providing a grinding head for a floor surface grinding machine, comprising:

a tool holder configured as a disc shaped plate, which in use is moved by the grinding machine, the tool holder being adapted to connect at least two grinding tools thereto;

a first and second grinding tool which are connectable to the tool holder;

wherein the tool holder comprises permanent magnets and the first and second grinding tool comprise magnetic or magnetizable material to cooperate with the permanent magnets on the tool holder in order to connect the first and second grinding tools to the tool holder, wherein the tool holder is provided with at least two pins for each grinding tool and each of the grinding tools are provided with complementary cavities which extend transverse to said plane of movement of the tool holder to prevent movement of the grinding tools with respect to the tool holder in a direction parallel to said plane when the grinding tools are connected to the tool holder, wherein the tool holder has a surface facing the grinding tools when connected thereto, wherein the tool holder comprises a recess for each magnet, and wherein the magnets are provided inside corresponding recesses such that a tool facing surface of the magnets lies recessed with respect to said tool facing surface of the tool holder, wherein the grinding head is provided with the first grinding tool connected to the tool holder and the second grinding head being separate from the tool holder;

disconnecting the first grinding tool from the tool holder by hand;

aligning the at least two pins with the associated cavities of the second grinding tool; and, connecting the second grinding tool to the tool holder by hand using the permanent magnets.

* * * * *